US006546703B1

(12) United States Patent
Cotter et al.

(10) Patent No.: US 6,546,703 B1
(45) Date of Patent: Apr. 15, 2003

(54) EQUINE COMMUNICATION ENHANCEMENT

(76) Inventors: Judy Cotter, 734 Martin Creek Rd., Williford, AR (US) 72482; Douglas Cotter, 734 Martin Creek Rd., Williford, AR (US) 72482

( * ) Notice: Subject to any disclaimer, the term of this patent is extended or adjusted under 35 U.S.C. 154(b) by 0 days.

(21) Appl. No.: 09/710,277

(22) Filed: Nov. 13, 2000

(51) Int. Cl.[7] ..... B68B 1/06
(52) U.S. Cl. ..... 54/8
(58) Field of Search ..... 54/7–9; 119/712, 119/905, 833

(56) References Cited

U.S. PATENT DOCUMENTS 509,968 A * 12/1893 Swan ..... 604/79
3,837,142 A * 9/1974 Hill ..... 54/6.1
4,040,422 A * 8/1977 Kuhn ..... 604/79
4,280,316 A * 7/1981 Taylor ..... 54/8
4,535,724 A * 8/1985 David ..... 119/712
5,557,905 A * 9/1996 Harding ..... 54/7
5,566,645 A * 10/1996 Cole ..... 119/712
5,809,939 A * 9/1998 Robart et al. ..... 119/712

FOREIGN PATENT DOCUMENTS

GB 2143132 * 2/1985 ..... B68B/1/06
GB 2286324 * 8/1995 ..... B68B/1/06

* cited by examiner

*Primary Examiner*—Peter M. Poon
*Assistant Examiner*—Son T. Nguyen

(57) ABSTRACT

A bridle having a bit with an elongated strip of flexible candy like sweetened material spirally wrapped along the length of the bit to provide positive reinforcement to an animal wearing the bridle.

5 Claims, 1 Drawing Sheet

EQUINE COMMUNICATION ENHANCEMENT

The present invention relates generally to devices for the control and communication with horses and the like and, more particularly, to accessories for enhancing such communication between horse and handler, whether it be a rider or trainer.

BACKGROUND OF THE INVENTION

1. Field of the Invention

Equines, as a family of domestic animals, have served mankind for centuries, some working in the fields, while others provide transportation. Such animals tend to be intelligent, and communication between the animal and its handler typically comes about through repetitive training, either by voice commands or selective applied pressure, or both.

In order to maintain some control over the animal's actions, and also to convey various commands, a bridle is fitted over the animal's head, and a bit, which is integral with the bridle, is fitted in the animal's mouth.

It is well established that equines are partial to sweets and are responsive to such things as a lump of sugar or an apple. By the same token, providing such treats manually has a certain amount of peril attached in that the animal, whose teeth are typically larger than the object of its desire, may inadvertently bite the hand that feeds it.

2. Overview of the Prior Art

While the proclivities of equines toward sweets is well known and widely documented, few have applied this knowledge in a manner which would permit them to take advantage of the animal's propensities in a safe and useful way.

Two such persons, however, have attempted to apply their knowledge in a manner which permits a rider or handler to reinforce commands with a system of rewards without placing one's hand at risk. Specific reference is made to Robart et al. U.S. Pat. No. 5,809,939 wherein a sweet, in liquid form may be administered through a rather ponderous plumbing system connected at one end to a bottle serving as a reservoir, and at the other, to a hollow tube serving as a bit. A pump and valving system permits a rider, while in the saddle, to inject a measured quantity of liquid in the bottle into the bit where it is discharged into the animal's mouth.

Another creative, but wholly impractical approach to positive reinforcement in an equine training environment, is found in Taylor U.S. Pat. No. 4,280,316. Taylor places a sugar cube in a domed enclosure on the upper surface of the bridle bit, where it can be selectively accessed by the animal at an appropriate time. The dome holds but one cube at a time, and the dome itself appears that it would be uncomfortable in the mouth of all but the very largest of animals.

Finally, there are several bit patents which are intended to dispense medicines directly to the horse's mouth. Among them are Mateer U.S. Pat. No. 1,091,683, Hill U.S. Pat. No. 3,837,142 and Lemons U.S. Pat. No. 617,583. None of these, however, teach the use of a bit for use in training, and/or calming, of the animal by use of sweets.

SUMMARY OF THE INVENTION

A young animal may be nervous around humans and rebel against being saddled. Further, it may well balk at having the bit in its mouth and/or be unresponsive to pressure on the reins as a means of communicating commands to the animal from the handler.

The presentation makes advantageous use of the response of equine breeds to sweets by providing sweets at the bridle bit without recourse to a liquid reservoir, pumps and hoses. Instead, it provides for the wrapping of a pliable stick of sweetened material about the bit such that the horse readily accepts the bit in its mouth and remains relatively content for extended periods of time.

It is, therefore, a principal objective of the present invention to create a pleasant and, therefore, a calm environment in which the animal is more willingly responsive to its handler by providing a sweet during an extended period.

Another objective of the present invention is to create a bridle bit which the animal will readily accept rather than fight. It is an objective related to the foregoing to provide for the accessorization of a bridle bit, whether it be new, or heavily used, to accomplish the objectives set forth herein. Further, it is an objective to provide a bit which will accomplish all of the foregoing objectives and which is renewable with minimal effort at any time.

The foregoing, as well as other objects and advantages of the present invention will become more apparent from a reading of the following Detailed Description of a Preferred Embodiment, when taken in conjunction with the drawings, wherein:

DETAILED DESCRIPTION OF A PREFERRED EMBODIMENT

Figure 1:
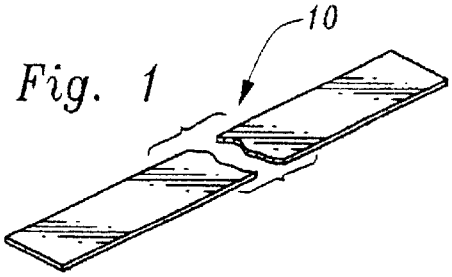
FIG. 1 is a perspective view of a strip of sweetened material, fractured to illustrate the dimensions thereof.

With reference now to the drawing, and initially to FIG. 1 thereof, a strip of sweetened material is there illustrated at 10. The object is referred to as sweetened material rather than candy in that the term is intended to be much more broad than what is colloquially thought of as candy.

The sweetened material 10 may be cooked or otherwise processed, and is typically an admixture of corn syrup, sugar, flavoring and, perhaps, a preservative.

In keeping with the objectives of the invention, the sweetened material is cohesive and extremely pliable. Further, it is intended to be soluble in the presence of saliva so that it will slowly dissolve in the mouth of a horse, or other animal.

A bridle is the device of choice for use in communicating with domestic animals such as horses and others of the equine family. Whether the animal is to be ridden, used for show, or a beast of burden, a bridle is fitted about the head of the animal and, as a means of control, a bit is fitted in the animal's mouth above the tongue.

Figure 2:
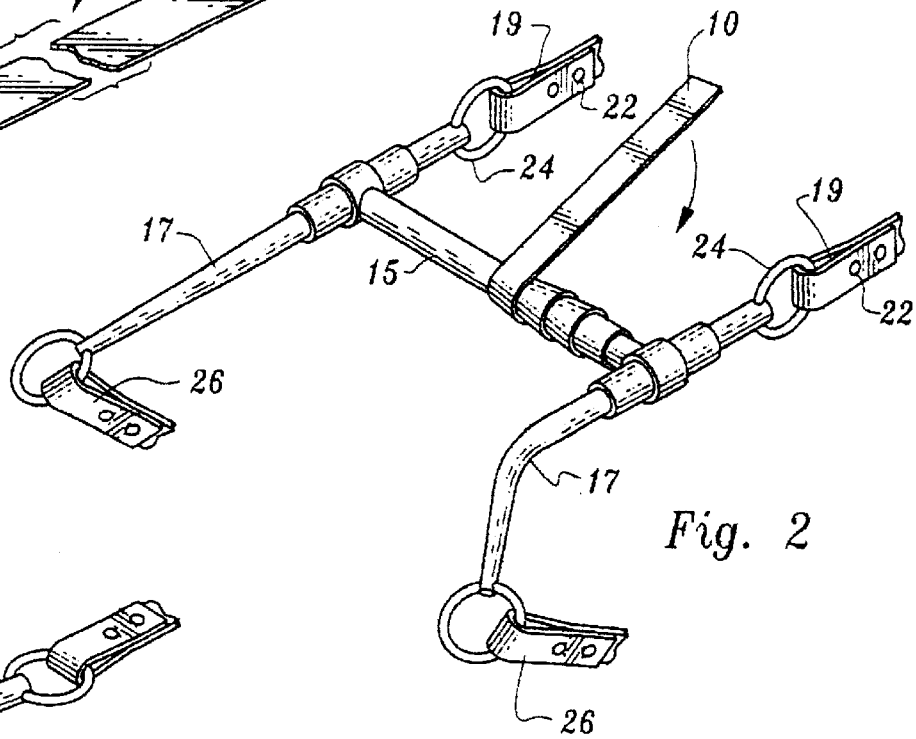
FIG. 2 is a perspective view of a portion of a bridle, shown in the area of the bit, and illustrating the bit being wrapped with the sweetened material as shown in FIG. 2.

Turning now to FIG. 2, a portion of a bridle 12 is shown in the immediate area of a bit 15. The bit, as illustrated, comprises a solid, relatively inflexible member, e.g., a stainless steel rod, and is flanked between support members 17 in the bridle 12. Straps 19 comprise a portion of the bridle which fits about the animal's head and are fixed by appropriate fasteners such as by rivets 22 in rings 24.

The bridle, as a means of control, includes a pair of reins 26 and, although two such reins are suggested, there are bridles which are functional with only one such rein. The reins are secured to the support members at a remote end of the support members 17. Pressure created pulling on, or laying over one or both of the reins on the animal dictate the command given.

Similarly, the bit 15, which passes transversely through the animal's mouth above the tongue and bears on sensitive areas of the mouth, serves as a constant reminder to the animal that he is to obey. As a consequence, training an animal to accept the bit and to respond to commands is a primary function of the training regimen. While theory and training techniques abound, there is a school of thought that believes positive reinforcement, as distinguished from punishment/avoidance, is the most effective teaching method.

Figure 3:
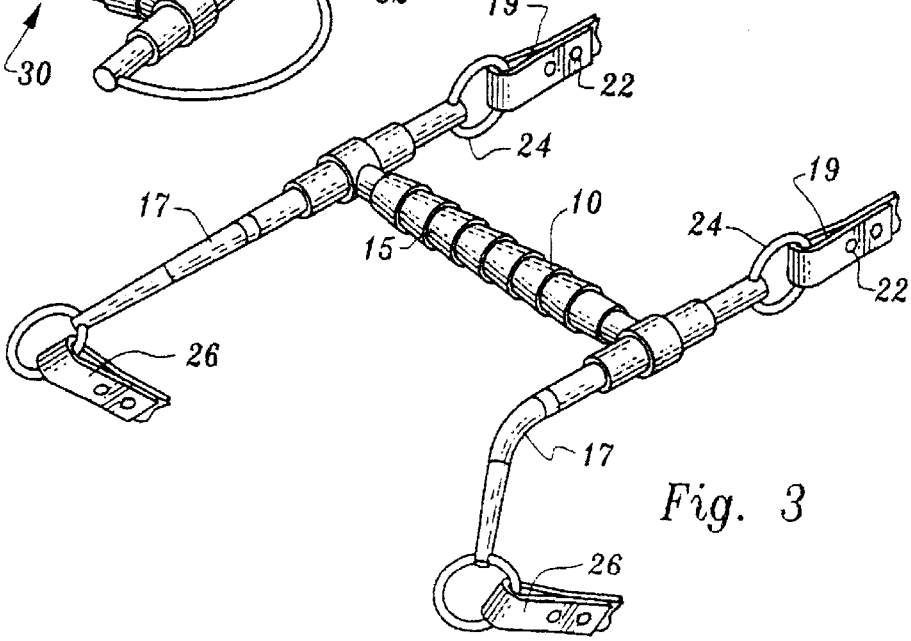
FIG. 3 is a view of the same portion of the bridle as shown in FIG. 2, with the bit completely wrapped in accordance with the present invention; and, FIG. 4 is a portion of a bridle with a modified bit having been wrapped with sweetened material of the type shown in FIG. 1.

In keeping with this philosophy, and in furtherance of the objectives outlined above, an elongate strip of sweetened material 10 is spirally wrapped about the bit for substantially its entire length as seen in FIGS. 2 and 3. Thus, when the bit is urged into the animal's mouth, a pleasant sensation is perceived which enhances the willingness of the animal to accept the bit. Thereafter, as the animal salivates, the sweetened material slowly dissolves, providing prolonged positive reinforcement.

Figure 4:
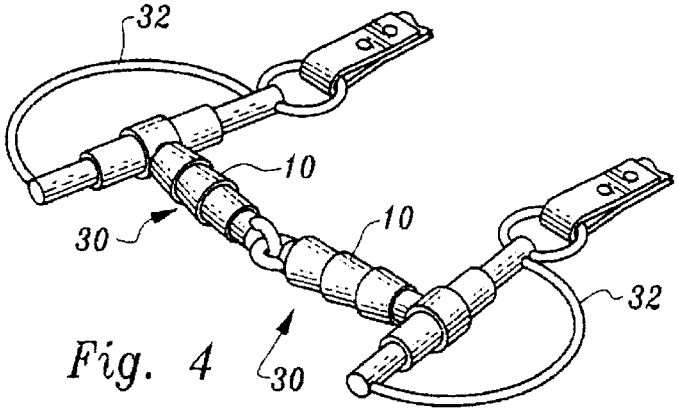

Referring to FIG. 4, a modified bridle/bit arrangement is provided in which the bit comprises two elongated rods, referred to as a broken D-ring snaffle bit, wherein the rods are joined at the center of the bit in such a fashion that the two parts are angularly displaceable relative to one another. There are D-rings 32 flanking the rods 30, which provide hand grips for control of the horse from ground level. Each rod is, in accordance with the invention, wrapped with sweetened material in the same fashion as the FIG. 2 embodiment.

Having thus described a preferred embodiment, what is claimed is:

1. A bridle, having a bit, for use in communication and control of an animal, said bit intended to fit transversely in the animal's mouth, and an elongate strip of sweetened material, said strip of elongate material being flexible and spiral wrapped around an outer surface of said bit, to impart a sweet sensation to the animal.

2. The bridle as set forth in claim 1, wherein said strip of sweetened material covers substantially all of the bit.

3. The bridge as set forth in claim 1, wherein said strip of sweetened material covers substantially all of the bit.

4. A bridle for use in communication and control of an animal, said bridle having a broken D-ring snaffle bit, said bit comprising a pair of rods, joined for relative angular movement, said bit intended to fit transversely in the animal's mouth, and an elongate strip of sweetened material, said strip of elongate material being wrapped around an outer surface of said bit to impart a sweet sensation to the animal.

5. The bridle as set forth in claim 4, wherein said strip of sweetened material covers substantially all of each rod of said broken bit.

* * * * *